US006446704B1

(12) United States Patent
Collins

(10) Patent No.: US 6,446,704 B1
(45) Date of Patent: Sep. 10, 2002

(54) CONTINUOUS CASTING MOLD PLUG ACTIVATION AND BLEEDOUT DETECTION SYSTEM

(76) Inventor: Richard J. Collins, 8017 E. Gunning Dr., Spokane, WA (US) 99212

( * ) Notice: Subject to any disclaimer, the term of this patent is extended or adjusted under 35 U.S.C. 154(b) by 0 days.

(21) Appl. No.: 09/333,776

(22) Filed: Jun. 15, 1999

Related U.S. Application Data

(63) Continuation of application No. 08/884,446, filed on Jun. 27, 1997, now abandoned.

(51) Int. Cl.[7] ..... B22D 11/10; B22D 11/16

(52) U.S. Cl. ..... 164/488; 164/452; 164/437; 164/151.5; 164/154.1

(58) Field of Search ..... 164/488, 452, 164/453, 151.5, 152, 437, 154.1

(56) References Cited

U.S. PATENT DOCUMENTS

| | | | | | |
|---|---|---|---|---|---|
| 3,593,773 | A | * | 7/1971 | Vogt et al. | 164/453 |
| 4,809,766 | A | * | 3/1989 | Greene et al. | 164/151.5 |
| 4,982,779 | A | * | 1/1991 | Nagai et al. | 164/152 |
| 5,409,054 | A | * | 4/1995 | Moriceau | 164/453 |
| 5,674,426 | A | * | 10/1997 | Schmid et al. | 164/453 |

* cited by examiner

*Primary Examiner*—Tom Dunn
*Assistant Examiner*—I.-H. Lin
(74) *Attorney, Agent, or Firm*—Wells St. John P.S.

(57) ABSTRACT

Disclosed is a mold plug activation system and bleedout protection system, which stops the flow of metal during predetermined conditions, such as during the initial introduction of molten metal to the molds or in the event a bleedout is detected in the mold.

9 Claims, 6 Drawing Sheets

30
31
32
34
62
62
66
66
37
37
33
64

CONTINUOUS CASTING MOLD PLUG ACTIVATION AND BLEEDOUT DETECTION SYSTEM

RELATED PATENT DATA

This patent application is a continuation resulting from U.S. patent application Ser. No. 08/884,446 which was an application filed on Jun. 27, 1997.

TECHNICAL FIELD

This invention pertains to a non-ferrous metal mold plug activation system and bleedout detection and plug off system, which stops the flow of metal during predetermined conditions, such as during the initial introduction of molten metal to the molds or in the event a bleedout is detected in the mold.

BACKGROUND OF THE INVENTION

Metal ingots and billets are typically formed by a casting process, which utilizes a vertically oriented mold situated above a large casting pit beneath the floor level of the metal casting facility. The lower component of the vertical casting mold is a starting block mounted on starting block pedestals. When the casting process begins, the starting blocks are in their upward-most position and in the molds. As molten non-ferrous metal is poured into the mold and cooled, the starting block is slowly lowered at a pre-determined rate by a hydraulic or pneumatic cylinder or other device. As the starting block is lowered, solidified non-ferrous metal or aluminum emerges from the bottom of the mold and ingots or billets are formed.

While the invention applies to casting of metals in general, including without limitations aluminum, brass, lead, zinc, magnesium, copper, steel, etc., the examples given and preferred embodiment disclosed are for aluminum, and therefore the term aluminum will be used throughout for consistency even though the invention applies more generally to metals.

While there are numerous ways to achieve and configure a vertical casting arrangement, FIG. 1 illustrates one example. In FIG. 1, the vertical casting of aluminum generally occurs beneath the elevation level of the factory floor in a casting pit. Directly beneath the casting pit floor 1*a* is a caisson 3, in which the pneumatic or hydraulic cylinder barrel 2 for the hydraulic cylinder is placed.

As shown in FIG. 1, the components of the lower portion of a typical vertical aluminum casting apparatus, shown within a casting pit 1 and a caisson 3, are a hydraulic cylinder barrel 2, a ram 6, a mounting base housing 5, a platen 7 and a starting block base 8, all shown at elevations below the casting facility floor 4.

The mounting base housing 5 is mounted to the floor 1*a* of the casting pit 1, below which is the caisson 3. The caisson 3 is defined by its side walls 3*b* and its floor 3*a*.

A typical mold table assembly 10 is also shown in FIG. 1, which can be tilted as shown by hydraulic cylinder 11 pushing mold table tilt arm 10*a* such that it pivots about point 12 and thereby raises and rotates the main casting frame assembly, as shown in FIG. 1. There are also mold table carriages which allow the mold table assemblies to be moved to and from the casting position above the casting pit.

FIG. 1 further shows the platen 7 and starting block base 8 partially descended into the casting pit 1 with billet 13 being partially formed. Billet 13 is on starting block 14, which is mounted on pedestal 15. While the term starting block is used for item 14, it should be noted that the terms bottom block and starting head are also used in the industry to refer to item 14, bottom block typically used when an ingot is being cast and starting head when a billet is being cast.

While the starting block base 8 in FIG. 1 only shows one starting block 14 and pedestal 15, there are typically several of each mounted on each starting block base, which simultaneously cast billets, special shapes or ingots as the starting block is lowered during the casting process.

When hydraulic fluid is introduced into the hydraulic cylinder at sufficient pressure, the ram 6, and consequently the starting block base 8, are raised to the desired elevation start level for the casting process, which is when the starting blocks are within the mold table assembly 10.

The lowering of the starting block base 8 is accomplished by metering the hydraulic fluid from the cylinder at a pre-determined rate, thereby lowering the ram 6 and consequently the starting blocks at a pre-determined and controlled rate. The mold is controllably cooled during the process to assist in the solidification of the emerging ingots or billets, typically using water cooling means.

There are numerous mold and casting technologies that fit into these mold tables. Some are generally referred to as "hot top" technology, while others are more conventional casting technologies that use floats and downspouts, both of which are known to those of ordinary skill in the art. The hot top technology generally includes a refractory system and molten metal trough system located on top of the mold table, whereas the conventional pour technology involves suspending or supporting the source of molten metal above the mold table and the utilization of down spouts or tubes and floats to maintain the level of molten metal in the molds while also providing molten metal to the molds.

These different casting technologies have different advantages and disadvantages and produce various billet qualities, but no one of which is required to practice this invention.

The metal distribution system is also an important part of the casting system. In the two technology examples given, the hot top distribution trough sits atop the mold table while the conventional pouring trough is suspended above the mold table to distribute the molten metal to the molds.

Mold tables come in all sizes and configurations because there are numerous and differently sized and configured casting pits over which mold table are placed. The needs and requirements for a mold table to fit a particular application therefore depends on numerous factors, some of which include the dimensions of the casting pit, the location(s) of the sources of water and the practices of the entity operating the pit.

The upper side of the typical mold table operatively connects to, or interacts with, the metal distribution system. The typical mold table also operatively connects to the molds which it houses.

When non-ferrous metal is cast using a continuous cast vertical mold, the molten metal is cooled in the mold and continuously emerges the lower end of the mold as the mold table is lowered. The emerging billet, ingot or other configuration is intended to be sufficiently solidified such that it maintains its desired shape. There is an air gap between the emerging solidified metal and the permeable ring wall. Below that, there is also a mold air cavity between the emerging solidified metal and the lower portion of the mold and related equipment.

Conditions may develop during the casting process which cause the molten aluminum to pass through the mold without sufficiently solidifying, such that instead of solidified metal emerging, molten metal leaks through. This is referred to as bleedout or breakout and not only creates a very dangerous condition, but causes substantial economic loss due to the physical damage that results and the downtime to the production line.

Systems directed to preventing or minimizing the effects of the bleedout situation must operate under very harsh conditions in the casting environment, conditions such as high heat, steam, exposure to molten metal, and exposure to corrosive elements in the air, to name a few.

Originally, workers were exposed to the dangerous bleedout condition because they were required to manually plug the mold entrance to prevent the further flow of molten metal through the mold experiencing the bleedout condition.

Other prior systems have been developed to attempt to remedy the well recognized problem. One example of such a prior system utilizes a relatively complicated optical sensor system which detects the presence of metal in the mold air cavity optically. Once a blockage is detected between a sensor positioned in the upper portion of the air gap and a sensor positioned in the lower portion of the air gap, a signal is sent to a controller. The optical sensors may also be positioned to detect molten metal in the mold air cavity. The controller generally receives the signal, interprets it and then sends a signal to a mold plug activation device, causing the mold plug to block the flow of metal to the mold. However, devices such as this are relatively complicated devices and involve placing sensors and controllers in the harsh casting environment, which is unnecessarily expensive, unduly complicated and not nearly as reliable as this invention.

Another example of such a prior system is one which places a heat sensing device or thermocouple in the mold air cavity, and then calibrating the thermocouple such that it sends a signal to a controller when a pre-determined temperature is reached. The temperature is pre-determined such that the signal is sent when a bleedout condition occurs. The sensor typically sends a signal to an electronic controller, which reads and interprets the signal, and then transmits another signal to a mold plug activation device, thereby causing the mold plug to block the flow of metal to the mold.

Examples of problems with these prior systems are: they require the use of an electronic or other controller to receive the signal from the sensor, interpret the signal, and then send a second signal to the mold plug activator; they do not operate reliably in such a harsh, hot and corrosive environment; they depend on reliably receiving a readable electrical signal of some sort from the sensor, in the harsh environment; they depend on the reliability of the controller, its ability to receive and interpret the signal, and its ability to then transmit a second to the mold plug activator; and there is an unacceptably long period of time during which the first signal is received and interpreted, and the second signal is transmitted to the mold plug activator.

Prior art systems simply depend on too many factors and components which do not operate reliably enough in a harsh environment, as well as too many components. The costs of the prior art systems are also higher than they need be, due to the number of components and the expense of attempting to provide if protection for the components from the operating environment.

It is also important in bleedout situations to stop the flow of metal very quickly, and in that regard, seconds and fractions of seconds can be critical. The prior system's use of less than reliable sensors combined with intermediate controllers, results in too many components and too many steps to finally activate and move the metal flow stop device into the metal flow cavity. This relative slowness in prior systems allows an unnecessarily large quantity of molten metal to flow through the mold without solidifying. This molten metal can ruin other equipment and require a substantial cost in downtime, cleanup and repair, not to mention subjecting the operator(s) to more danger.

The forenamed recognized needs have not heretofore been sufficiently fulfilled by existing systems.

It is a primary object of this invention to provide a system which will operate reliably in a harsh environment. It is also an object of this invention to provide such a system which requires fewer components, and preferably fewer or no electronic components.

It is a further object of this invention to utilize components which are more reliable in the harsh operating environment of a metal casting facility, preferably to avoid using an electronic controller in particular.

It is a still further object of this invention to provide such a system which stops the flow of molten metal through the mold substantially faster than prior systems, when substantially faster can mean merely a fraction of a second.

If This invention accomplishes these objectives by providing a mold plug activation system wherein the sensor is preferably directly connected pneumatically, electrically, mechanically, or otherwise, to the mold plug activator. This invention preferably avoids the use of intermediate controllers between the sensor and the mold plug activator.

There is also a problem with existing mold tables during startup or during the initial introduction of molten metal to each of the molds. While it would be preferred to provide the metal to each of the mold cavities at approximately the same time, it is rarely achieved to the degree desired due to the flow times for the molten metal to flow through the troughs and get to each mold inlet. This can lead to casting problems when the platen is being lowered and some of the molds have not yet received the molten metal. Related to the need or ability to simultaneously stop the flow of metal to all molds on a table during a pre-determined event, is the ability of a system to block the flow of metal in the event of a power outage.

It is therefore also an objective of this invention to provide such a system which may also be used to provide molten metal to the numerous mold cavities at the same approximate time during startup. This is accomplished in one or more of the embodiments of the invention, wherein for instance in the hydraulic or pneumatic embodiment, the balancing hydraulic/pneumatic pressure can be introduced to each mold plug at the same time, thereby raising each of the mold plugs at the same time, after the molten metal has substantially filled all the applicable troughs. This invention further allows utilizes an activation system which may be placed in the normally closed position such that when power to the molds is lost, the metal flow stop devices move to block the continued flow of metal to the mold inlets.

This invention can also accomplish these objectives by providing a mold plug activation system wherein the sensor is sacrificed in the event of a mold bleedout, i.e. a disposable or sacrificial sensor, which is partially or wholly destroyed or sacrificed in the event of a bleedout.

In accomplishing these objectives, this invention provides a system which is simpler, more reliable and safer than all prior systems, and which should reduce the risk of injury to workers in casting facilities.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

Figure 1:
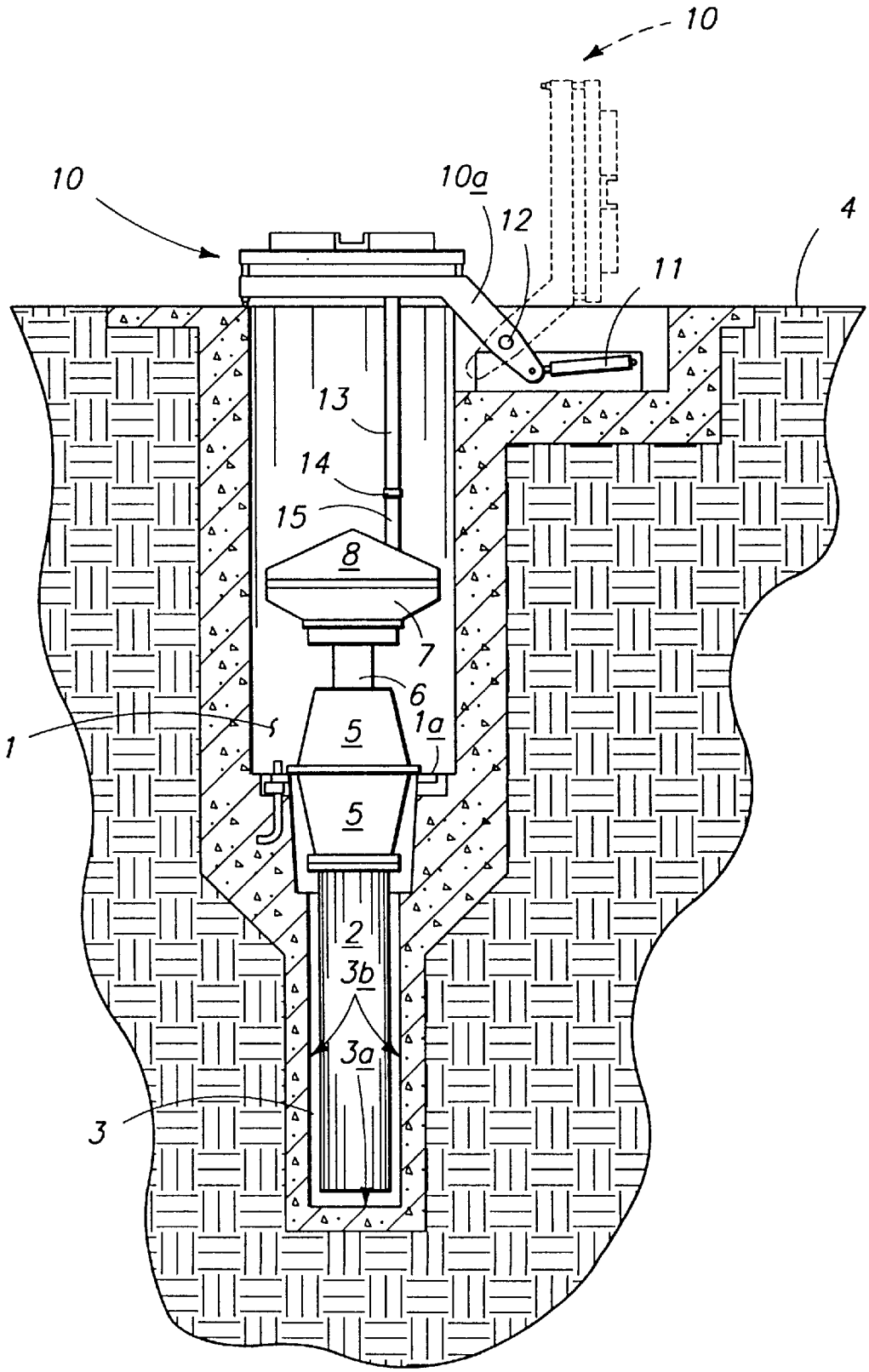
FIG. 1 is an elevation view of a typical casting pit, caisson and aluminum casting apparatus.

This disclosure of the invention is submitted in furtherance of the constitutional purposes of the U.S. Patent Laws "to promote the progress of science and useful arts" (Article 1, Section 8).

Many of the fastening, connection, process and other means and components utilized in this invention are widely known and used in the field of the invention described, and their exact nature or type is not necessary for an understanding and use of the invention by a person skilled in the art or science, and they will not therefore be discussed in significant detail. Furthermore, the various components shown or described herein for any specific application of this invention can be varied or altered as anticipated by this invention and the practice of a specific application of any element may already be widely known or used in the art or by persons skilled in the art or science and each will not therefore be discussed in significant detail.

It is to be understood that this invention applies to and can be utilized in connection with various types of metal pour technologies and configurations, including but not limited to both hot top technology and conventional pour technology. It is further to be understood that this invention may be used on horizontal or vertical casting devices.

The mold therefore must be able to receive molten metal from a source of molten metal, whatever the particular source type is, whether it be hot top pour technology or a conventional pour apparatus. The mold cavities in the mold must therefore be oriented in fluid or molten metal receiving position relative to the source of molten metal.

Although the description and background discuss vertical molds, this invention equally applies to horizontal molds.

The term metal flow stop device as used herein can be any one of a number of different devices. Examples of metal flow stop devices currently known are, without limitation, mold plugs and metal trough dams, rotatable trough dams, slide devices, and any others which stop the flow of molten metal to the mold inlet, as shown in the drawings and further described below and as known in the art.

The term metal flow cavity as used herein can be any one of a number of different cavities, conduits, or troughs. Examples of metal flow cavities as used herein and which are currently known are, without limitation: a mold inlet for receiving molten non-ferrous metal; or a trough or conduit configuration through which molten metal is supplied to a mold.

Although it is preferred to stop the flow of metal only to the mold experiencing the condition, this invention also contemplates that the flow of metal to more than one mold can also be stopped by applying the metal flow stop device to a metal flow cavity which provides molten metal to more than one mold.

The term failure condition as used herein may mean any one of a number of conditions which are desired to be detected or monitored. Example of failure conditions contemplated by this invention, without limitation, may be a mold bleedout or breakout condition, or an overheating condition in one or more predetermined locations.

A biasing force as used herein and as contemplated by this invention, can be accomplished or achieved in any one of a number of different ways. The term biasing force as used herein is intended broadly enough so that the force of gravity may be used as the biasing force, such that imparting a biasing force is meant to include using the weight of the metal flow stop device itself (or weights attached to it) as the biasing force, in addition to the many other ways that can be used to impart a force on the metal flow stop device.

When the term "increasing the biasing force" is used, it is meant herein and contemplated by this invention to include any device or method which serves to increase the biasing force on the metal flow stop device.

A balancing force as used herein and as contemplated by this invention, can also be accomplished in any one of a number of different ways. Examples of ways to achieve or impart a balancing force within the contemplation of this invention may be, without limitation: providing a pneumatic pressure opposing the biasing force; providing an overhead support such as the rope and pulley configuration, as more fully illustrated and described in reference to FIG. 3; or even a rigid support member preventing the metal flow stop device from being moved into the metal flow cavity by the biasing force.

When the phrase "reducing the balancing force" is used herein, it is not intended to be limited to just reducing, but instead also may mean eliminating the balancing force. The reduction or elimination of the balancing force allows the biasing force to move the metal flow stop device into a predetermined metal flow cavity, to effectively stop the flow of metal.

Increasing the biasing force or reducing the balancing force (or both) are directed to causing the metal flow stop device to be moved into the metal flow cavity, to stop the flow of metal to the blowout or other non-desirable condition.

Those skilled in the art will appreciate there may be many examples of embodiments within the contemplation of this invention for achieving biasing forces and balancing forces, and causing the metal flow stop device to move into the metal flow cavity, a few of which are given below.

Figure 2:
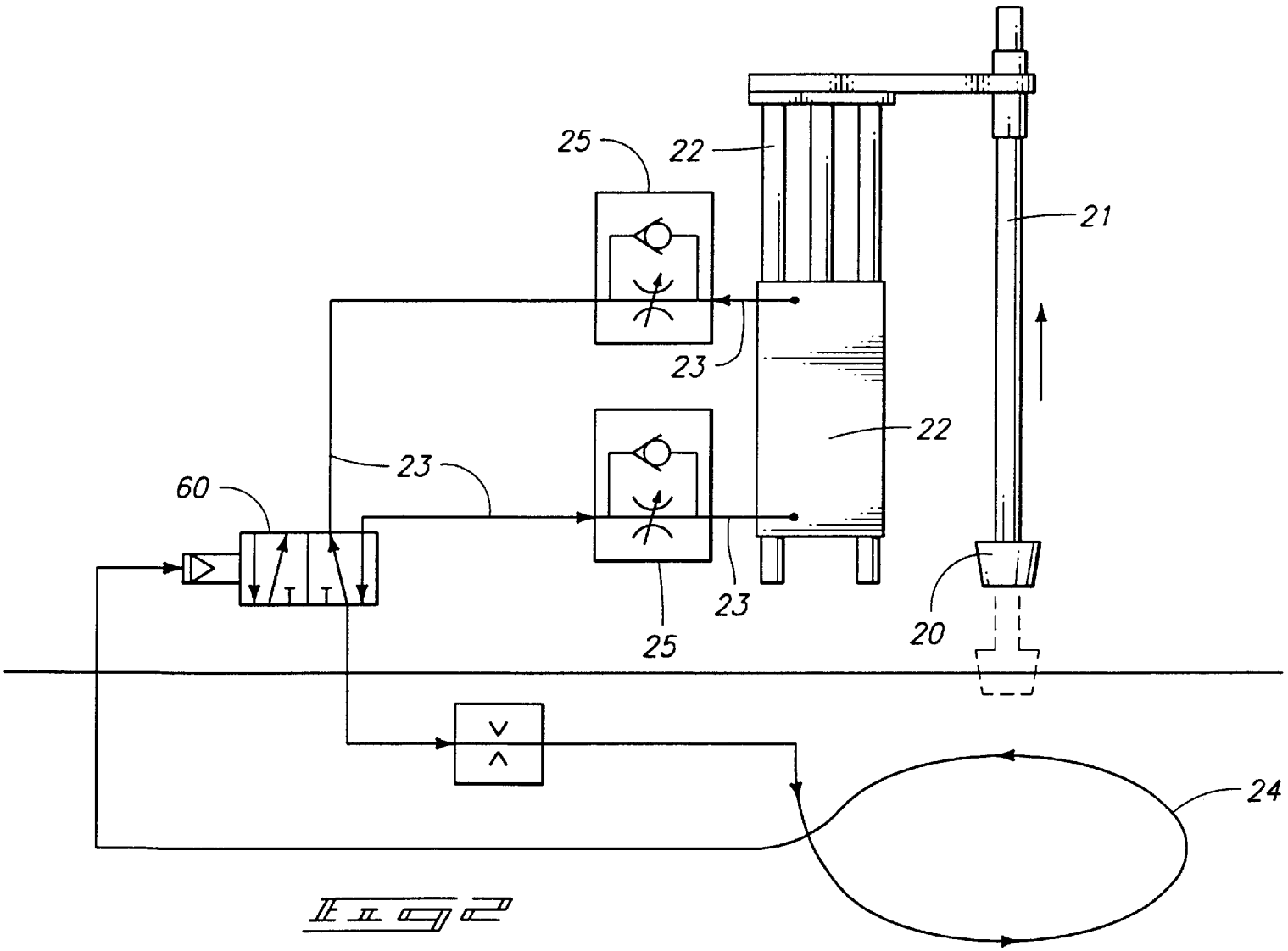
FIG. 2 is a schematic representation of one embodiment of the invention, which utilizes hydraulics or pneumatics to achieve the biasing force and balancing force.

A first example is the utilization of a pneumatic cylinder to facilitate the movement of the metal flow stop device into the metal flow cavity, which is schematically illustrated in FIG. 2. In FIG. 2, the metal flow cavity is not actually depicted, however, the metal flow stop device is mold plug 20 attached to mold plug stem 21.

In FIG. 2, a guided air cylinder 22 is provided wherein a source of compressed air is supplied through an airline 23 operatively connected to the guided air cylinder 22, as depicted in FIG. 2. The system may be configured so that either gravity or a second airline provides the biasing force on the metal flow stop device 20, which is connected to and moves with the air cylinder 22. The air cylinder 22 is available through SMC Pneumatics, Inc., of Indianapolis, Ind.

A compressed airline 23 is operatively connected or in fluid communication with the lower end of the air cylinder 22. This will be referred to as the balance air. The balance air line is operatively connected to a source of compressed air and is also operatively connected to or in fluid communication with a sacrificial sensor line 24, which in this case is a polymer or plastic air line.

The sacrificial sensor line 24 is positioned in the vicinity below the mold inlet where the metal is supposed to be emerging in solidified form, i.e. in the mold air cavity. In this example, the sacrificial sensor 24 is a polymer air line which encircles the solidified metal emerging from lower portion of the mold.

When a bleedout condition occurs, the molten metal flowing through the mold contacts the sacrificial sensor 24, and destroys the containment of the compressed air. This effectively reduces or eliminates the balancing force, which allows the biasing force to move the air cylinder downward, and which consequently moves the connected metal flow stop device into the metal flow cavity.

When the term destroyed is used in reference to the sacrificial sensor, it is intended to be construed broadly such that the sacrificial sensor can be partially or wholly destroyed. This typically occurs to cause the reduction or elimination of the balancing force opposing the biasing force imparted on the metal flow stop device. When the air pressure balancing or holding the biasing force is reduced or eliminated, the guided air cylinder 22 allows or forces the metal flow stop device, in this case a mold plug 20, to move into the mold inlet.

FIG. 2 illustrates the use of a cylinder lift valve 60, which in the pneumatic embodiment of this invention would be an air piloted cylinder lift valve 60. The cylinder lift valve 60 shifts the application of pressure when activated, from below the cylinder to above it, thereby causing the metal flow stop device, i.e. the mold plug 20, to move toward and block the flow of metal.

It will be appreciated by those skilled in the art that in this first example, the various elements of the apparatus and process of the system can be accomplished in other ways. For instance, instead of using an air line as the sacrificial sensor, one could use a sacrificial electrical line operatively connected to the cylinder lift valve 60. In that case, the cylinder lift valve 60 would be a solenoid piloted valve and operate in essentially the same manner with respect to the guided cylinder 22.

FIG. 2 also shows flow control devices 25, which are flow control devices available through SMC Pneumatics, Inc. of Indianapolis, Ind.

It will also be appreciated from the embodiment depicted in FIG. 2 how a plurality of metal flow stop devices, as provided by this invention, may be placed in the normally closed position. For example, the mold plug 20 would be normally positioned within the mold inlet, and when the system is energized, the mold plug 20 would be removed from the metal inlet and thereby allow the flow of metal through the mold inlet.

On startup on a mold table with a plurality of molds, the molten metal can be introduced in the conduit or trough system and distributed to positions near each mold inlet. Then once the mold troughs are sufficiently full of molten metal, the system may be activated, thereby simultaneously introducing the molten metal to each mold inlet.

It will further be appreciated by those skilled in the art how this invention may be utilized in situations where there is a loss of electrical energy or power to the molds on a mold table during times when molten metal is still contained within the troughs or conduits (the molten metal delivery system). Since the metal flow stop devices are normally closed, the loss of power will cause the cylinder lift valve 60 to decrease the pneumatic pressure or balancing force, thereby causing the metal flow stop devices to stop the block the flow of metal when power is lost.

Figure 3:
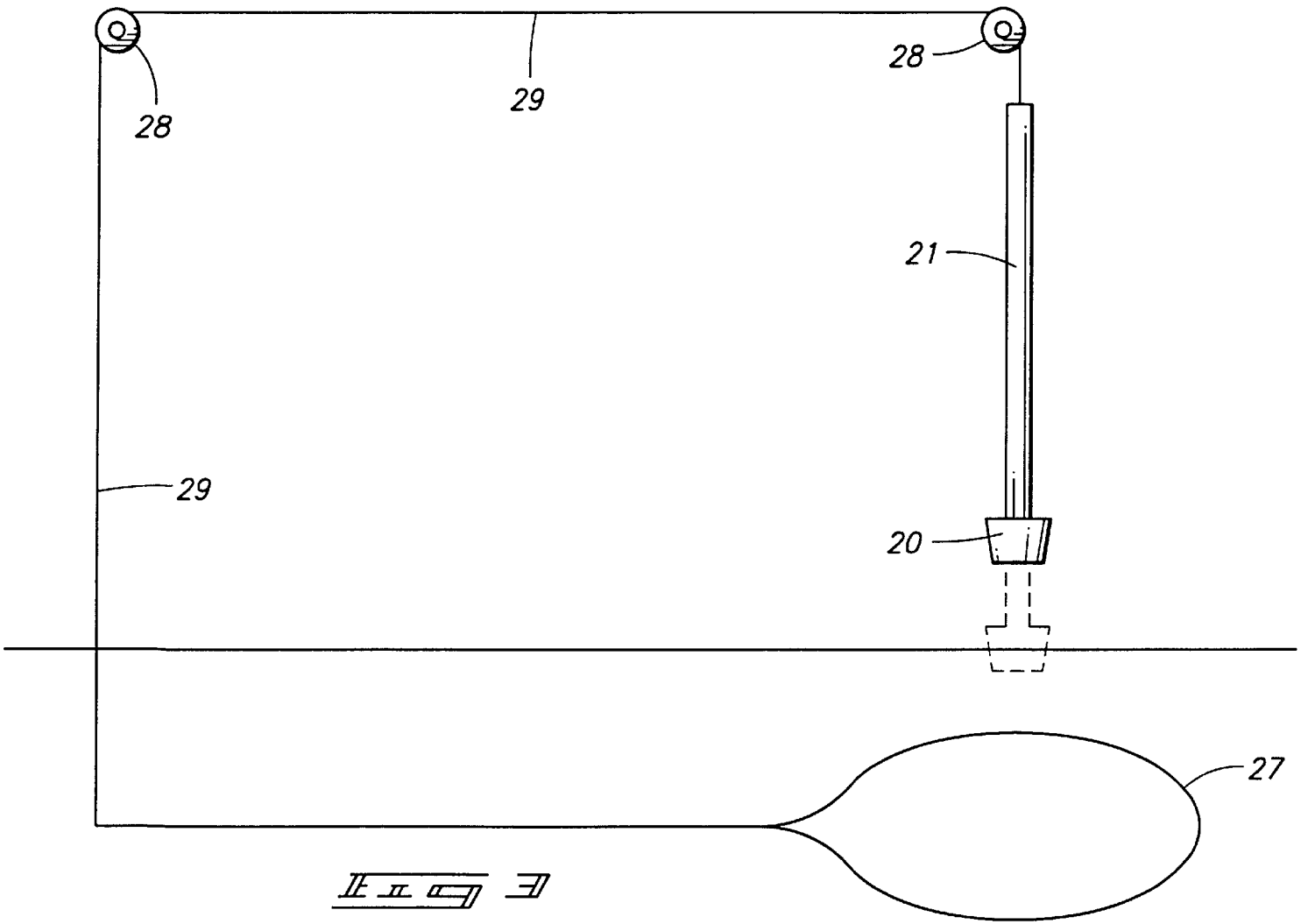
FIG. 3 is a schematic representation of one embodiment of the invention, which utilizes gravity as the biasing force and a cable or rope to achieve the balancing force.

FIG. 3 illustrates a second example, which is one of the simpler embodiments of the invention. In the example illustrated in FIG. 3, the metal flow cavity being blocked is the mold inlet for the affected mold and the metal flow stop device is a mold plug.

In the second example as illustrated in FIG. 3, the metal flow stop device is a mold plug 20 attached to mold plug stem 21, and is suspended or supported above the metal flow cavity. The force of gravity is utilized as the biasing force and the magnitude of the force is determined by selecting the weight desired for the metal flow stop device.

The balancing force in the second example is imparted by a supporter, which in the example shown may be a rope 29 or cable, and may be made of any one of a number of different material or combinations of materials, as will be appreciated by those skilled in the art. The upper portion of the supporter is operatively connected to the mold plug stem 21, either directly or indirectly, and effectively suspends the metal flow stop device above the metal flow cavity. The upper portion may be located vertically above the metal flow stop device, such as by a pulley structures 28.

The supporter lower portion 27 can be located in the vicinity of where the solidified metal emerges from the mold, which is generally below the mold inlet and within the mold air cavity, which is illustrated as item 37 in FIGS. 4 & 5 for example. Part or all of the supporter lower portion 27 can be made of a material that will be destroyed by contact with molten metal, such as rope, organic material, polymers, or many other compositions.

The supporter lower portion 27 may be positioned in one or more locations, or all around the emerging solidified metal, to quickly detect a bleedout on any side of the emerging metal.

When a bleedout condition is encountered, the molten metal would then contact the supporter lower portion 27 and destroy it, for example by burning an organic rope. The destruction of the supporter lower portion 27 would result in the elimination of the balancing force, and the biasing force would then cause the metal flow stop device to move into the desired metal flow cavity and block the flow of the molten metal to the mold wherein the bleedout occurred. The supporter lower portion 27 would therefore operate as a sacrificial sensor.

It will be appreciated by those skilled in the art that in the example schematically represented in FIG. 3, the various elements of the apparatus and process of the system can be accomplished in other ways. For instance, instead of using a flexible supporter positioned above the metal flow stop device held in place by, a pulley, one could utilize a much less flexible or even a rigid supporter, positioned below the metal flow stop device.

The supporter lower portion 27 would then be the sacrificial sensor in that it would be appropriately positioned below the mold inlet such that when molten metal from a bleedout condition contacts the lower portion of the supporter (the sacrificial sensor), it would be destroyed. The destruction of the supporter would reduce or eliminate the balancing force and allow gravity (as the biasing force) to cause the movement of the metal flow stop device into the metal flow cavity.

It will be appreciated by those skilled in the art that the supporter may be positioned in any one of a number of locations relative to the metal flow stop device, including above, below, or transverse.

Figure 4:
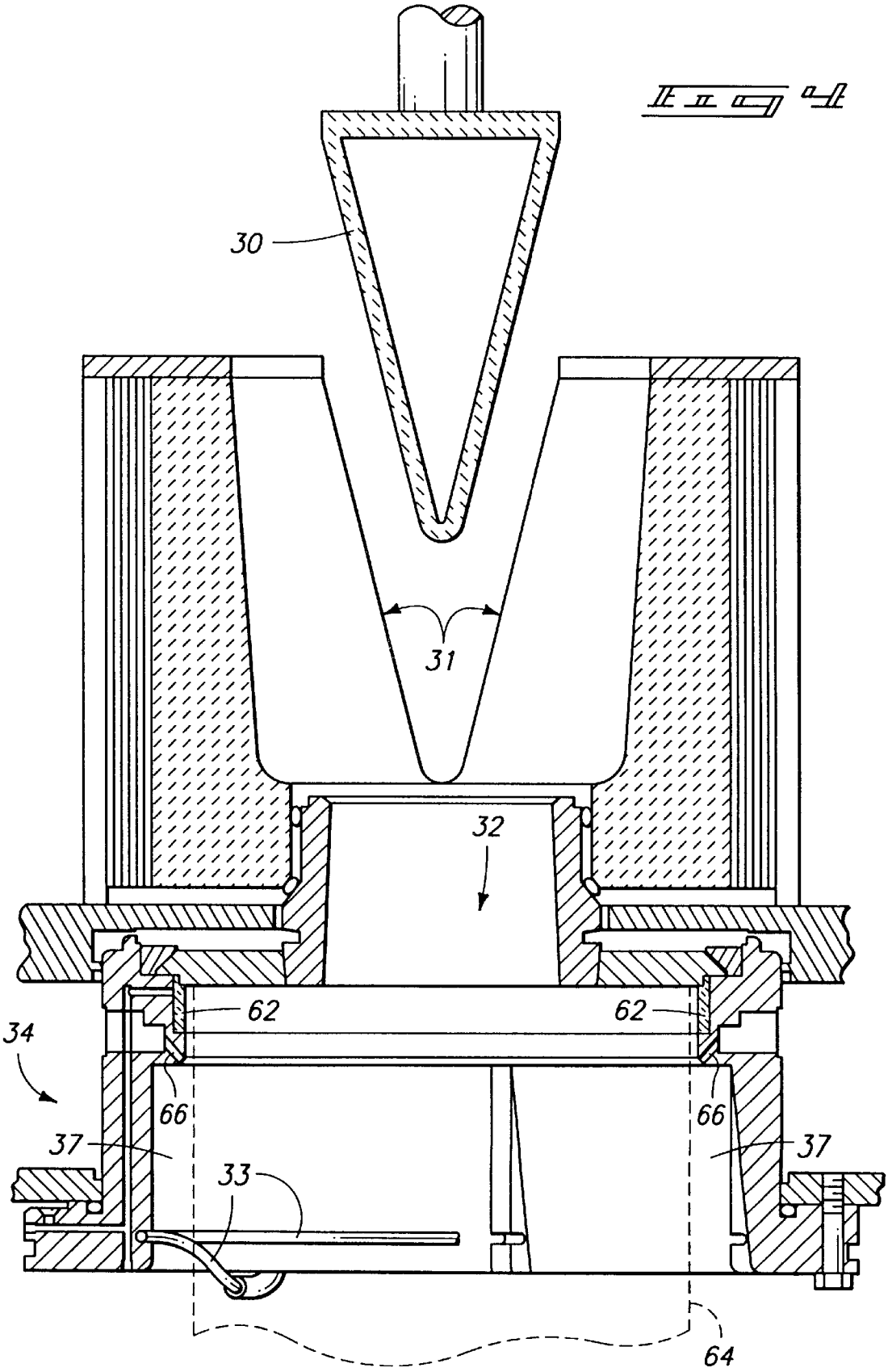
FIG. 4 is an elevation section view of one embodiment of a mold contemplated by this invention, wherein the metal flow stop device is a dam and is inserted into a metal supply flow trough to stop the flow of metal to the mold.

FIG. 4 is a cross sectional illustration of an embodiment of the invention wherein a metal trough dam 30 is the metal flow stop device, which moves into the metal trough 31 to block the flow of metal to the subject mold(s). The metal trough 31 is typically refractory material.

FIG. 4 illustrates a permeable graphite ring wall 62, through which a lubricant and a gas are permeated and which create an air gap between the emerging solidified metal 64 and the graphite ring wall 62. The emerging solidified metal 64 can be any one of a number of shapes, including billets, ingots or any other special shapes.

FIG. 4 also illustrates coolant outlets 66 from which water as the coolant is discharged to cool and provide the cooling for the solidification of the metal as it emerges into the mold outlet cavity. The portion of the mold outlet cavity between the emerging solidified metal and the mold housing is referred to herein as the mold air cavity 37. It is in the mold air cavity 37 where the sacrificial sensor is most effectively placed to detect a bleedout condition.

FIG. 4 also illustrates the mold inlet 32, the sacrificial sensor 33, which in this embodiment is the plastic air line as depicted in FIG. 2, as item 24. The sacrificial sensor 33 is shown positioned around the periphery below the lower portion of the mold inlet 32, which would surround the emerging solidified billet under normal operating conditions. FIG. 4 illustrates a typical casting mold 34 and related components, all of which are generally known by those skilled in the art.

Item 37 in the area below the mold inlet 32 represents the mold air cavity 37, in which there should be no molten metal during normal or desired operations.

It will be appreciated by those skilled in the art that forcing the metal flow stop device toward or into the metal flow cavity may be accomplished in more than one way within the contemplation of this invention. For example in FIG. 4, the metal flow stop device is a metal trough dam 30. In that example, an alternative way to force the metal flow stop device toward the metal flow cavity is to make the metal trough dam 30 relatively flat so that when it is aligned with the flow of metal in the trough, molten metal is allowed to flow by it and to the mold inlet 32. However, when a bleedout is detected, activating the metal trough dam 30 may result in merely rotating it ninety degrees to stop the flow of molten metal through the metal trough 31.

Figure 5:
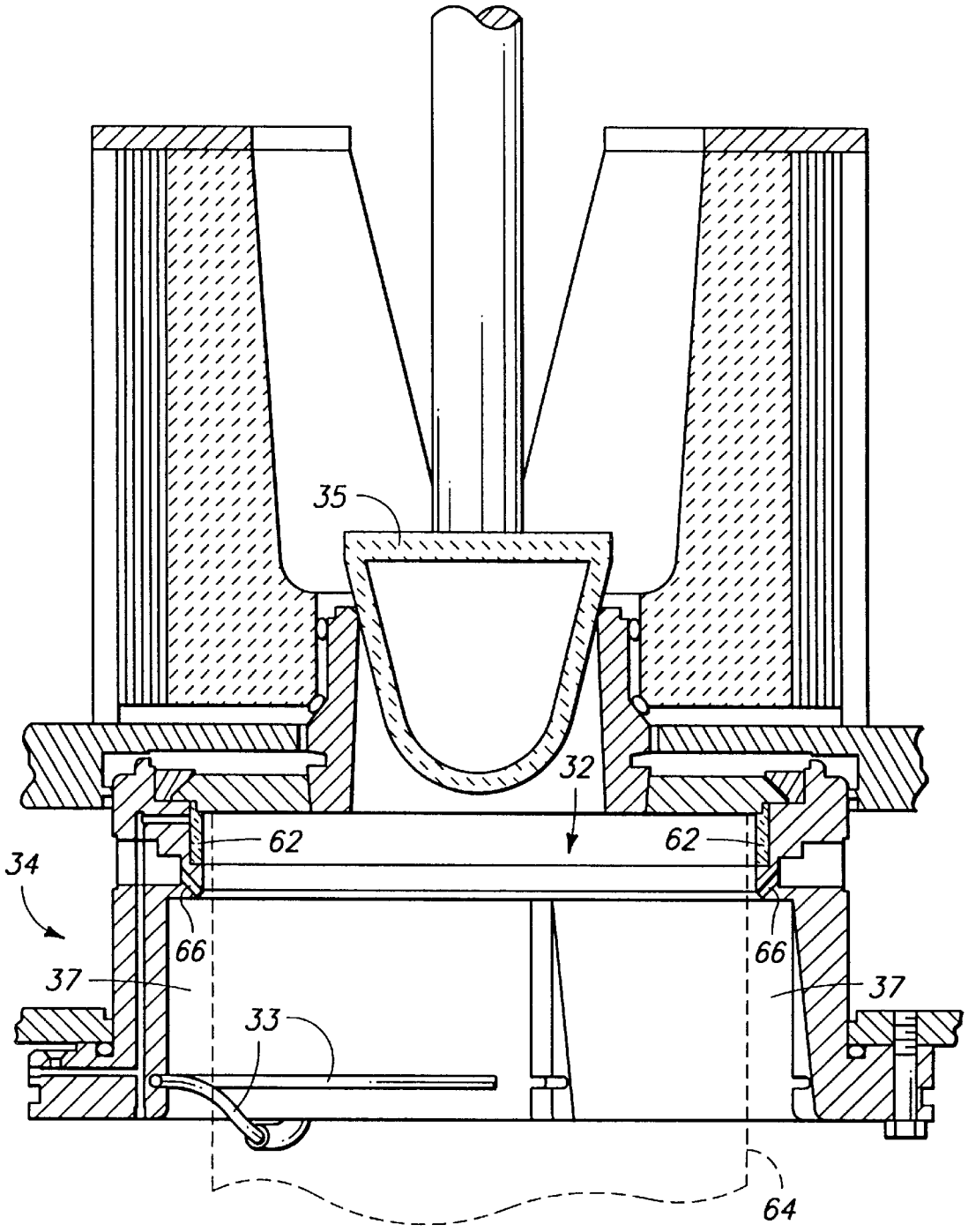
FIG. 5 is an elevation section view of one embodiment of a mold contemplated by this invention, wherein the metal flow stop device is a mold plug which is inserted into the mold inlet to stop the flow of metal to the mold.

FIG. 5 illustrates an embodiment of the invention in which a mold plug 35 is used to stop the flow of molten metal through the mold inlet 32 when a pre-determined condition occurs, such as a bleedout condition. The like item numbers in FIG. 5 correspond to the item numbers or reference numerals in FIG. 4.

Figure 6:
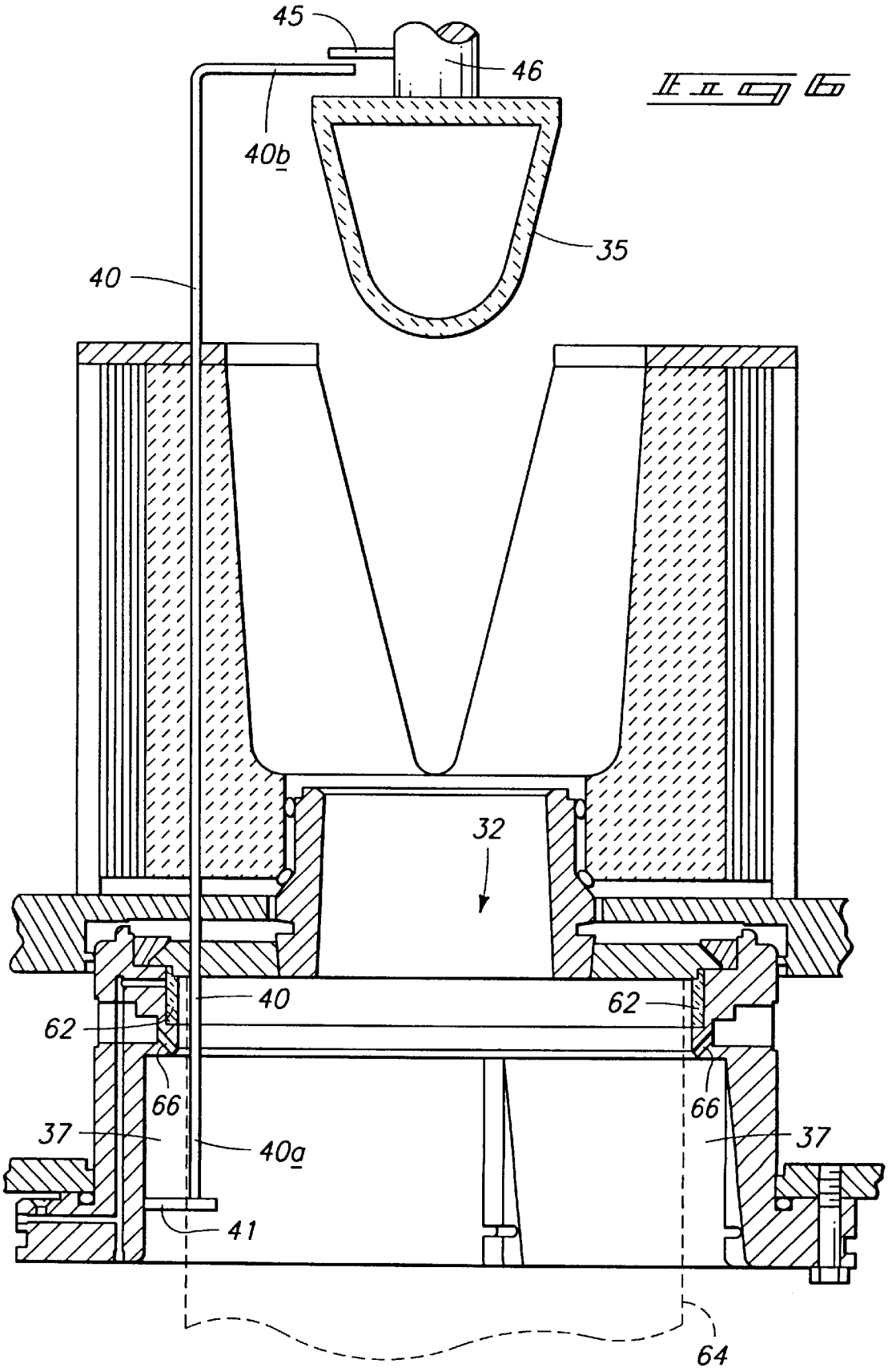
FIG. 6 is an elevation section view of one embodiment of a mold contemplated by this invention, wherein the metal flow stop device is a mold plug which is inserted into the mold inlet to stop the flow of metal to the mold, and which further illustrates a string and pulley combination to achieve the balancing force.

FIG. 6 illustrates an embodiment of the invention wherein the balancing force is achieved by means of support 40, which in this embodiment would be rigid. The support lower portion 40*a* would be the portion that would be partially or wholly destroyed, or the sacrificial sensor, and the upper portion of support 40 would serve to support the metal flow stop device, a mold plug 35, above the mold inlet 32. The mold plug stem 46 may be fitted with a mold plug stem platform 45 to interact with the support upper portion 40*b*. FIG. 6 also illustrates how another lower support 41 may be used as part of the support lower portion 40*a,* wherein the lower support 41 is the sacrificial sensor destroyed by the presence of molten metal.

The like item numbers in FIG. 6 correspond to the item numbers or reference numerals in FIG. 5 and FIG. 4.

It will also be appreciated by those skilled in the art that the hydraulic or pneumatic embodiment of this invention may be used as a system for initiating the flow process by filling the metal distribution system prior to allowing the flow of molten metal through any one of the mold cavities. In that regard, either the biasing force can start higher than the balancing force by increasing the biasing force or by decreasing or eliminating the balancing force. This will be most effective if mold plugs are the metal flow stop devices used.

Once all the metal flow stop devices are in place and preventing the flow of metal to the mold cavities, molten metal can be allowed to fill the metal troughs while not flowing through the mold cavities, Then balancing force can be increased, thereby simultaneously removing the mold plugs from the mold cavities and allowing for the approximate simultaneous introduction of molten metal to each of the mold cavities.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. In a continuous casting mold for metal, a system for stopping a flow of molten metal through a mold cavity, comprised of:

a. a metal casting mold with a metal flow cavity;

b. a metal flow stop device which corresponds to the metal flow cavity;

c. a source of a biasing force, disposed to impart the biasing force on the metal flow stop device toward its blocking the metal flow cavity;

d. a source of a balancing force, disposed in opposition to the biasing force on the metal flow stop device;

e. a sacrificial sensor operatively connected to the source of the balancing force, and positioned in molten metal detecting disposition to the outlet of the mold and to be destroyed in the presence of molten metal; and wherein destruction of the sacrificial sensor sufficiently reduces the balancing force, thereby allowing the biasing force to move the metal flow stop device into the metal flow cavity.

2. A system for stopping a flow of molten metal through a continuous casting mold, comprising:

a. a casting mold system, which includes a mold inlet which receives a flow of molten metal;

b. a metal flow stop system comprised of:

i. a metal flow stop device;

ii. a sacrificial sensor operatively connected to the metal flow stop device;

wherein the destruction of the sacrificial sensor causes the metal flow stop device to move into the mold inlet and thereby stop the flow of molten metal through the mold inlet.

3. In a continuous casting mold for metal, a system for stopping a flow of molten metal through the mold inlet, comprised of:

a. a metal casting mold with a metal flow cavity;

b. a metal flow stop device which corresponds to the metal flow cavity;

c. a guided pneumatic cylinder to which the metal flow stop device is attached such that the metal flow stop device is insertable relation to the metal flow cavity; and d. a sacrificial molten metal sensor operatively connected to the guided pneumatic cylinder and positioned in molten metal detecting disposition to the outlet of the mold.

4. A system for stopping a flow of molten metal through a mold inlet as recited in claim 3, and wherein the sacrificial molten metal sensor is a sacrificial pneumatic air line operatively connected to the guided pneumatic cylinder, in pressure-applying disposition to the movement of the metal flow stop device toward its blocking the metal flow cavity, and positioned in molten metal detecting disposition to the outlet of the mold.

5. A method for stopping a flow of molten metal to a continuous cast mold, comprising the following steps:

a. providing a metal flow stop device;

b. imparting a biasing force on the metal flow stop device toward its blocking a metal flow cavity;

c. providing a source of balancing force which opposes the biasing force on the metal flow stop device, such that the balancing force prevents the biasing force from moving the metal flow stop device into the mold inlet;

d. providing a sacrificial sensor operatively connected to the source of balancing force and positioned in molten metal detecting disposition relative to the outlet of the mold; and e. detecting molten metal by the destruction of the sacrificial sensor, which causes reduction in the balancing force and thereby causes the metal flow stop device to move into the metal flow cavity.

6. A method for stopping a flow of molten metal to a continuous cast mold as recited in claim 5, and wherein reducing the balancing force is the elimination of the balancing force.

7. A method for stopping a flow of molten metal to a continuous cast mold as recited in claim 6, and wherein reducing the balancing force is the elimination of the balancing force.

8. A method for initiating a flow of molten metal to a plurality of continuous cast molds, comprising the following steps:

a. providing a plurality of molds with mold cavities;

b. providing a molten metal trough for each of the molds;

c. providing a plurality of mold plugs, each corresponding to and inserted into one of the molds, and each blocking the flow of metal through a mold inlet;

d. providing molten metal to each of the molten metal troughs;

e. simultaneously introducing a balancing force to each of the mold plugs, thereby causing each of the mold plugs to be removed from its corresponding mold inlet; and f. thereby causing the simultaneous introduction of molten metal into the plurality of molds.

9. In a continuous casting mold for metal, a method for stopping a flow of molten metal through a mold inlet, comprised the following steps:

a. providing a metal flow cavity;

b. providing a metal flow stop device which corresponds to the metal flow cavity;

c. providing a guided pneumatic cylinder to which the metal flow stop device is attached such that the metal flow stop device is in insertable relation to the metal flow cavity;

d. providing a sacrificial pneumatic air line operatively connected to the guided pneumatic cylinder, which provides balancing pressure to the movement of the metal flow stop device toward its blocking the metal flow cavity, and positioned in molten metal detecting disposition to the outlet of the mold;

e. detecting the presence of molten metal by destruction of the sacrificial pneumatic air line, thereby removing balancing pressure resisting movement of the metal flow stop device into the metal flow cavity; and f. allowing the metal flow stop device to move into the metal flow cavity, thereby stopping the flow of molten metal through the mold inlet.

* * * * *